US009700479B2

(12) United States Patent
Tsai

(10) Patent No.: US 9,700,479 B2
(45) Date of Patent: Jul. 11, 2017

(54) FOLDABLE WALKER

(71) Applicant: Care & Care Health Products Co., Ltd., Yuan Li Town (TW)

(72) Inventor: Max Tsai, Yuan Li Town (TW)

(73) Assignee: CARE & CARE HEALTH PRODUCTS CO., LTD., Miao Li County (TW)

( * ) Notice: Subject to any disclaimer, the term of this patent is extended or adjusted under 35 U.S.C. 154(b) by 0 days.

(21) Appl. No.: 15/175,148

(22) Filed: Jun. 7, 2016

(65) Prior Publication Data

US 2016/0374890 A1 Dec. 29, 2016

(30) Foreign Application Priority Data

Jun. 29, 2015 (TW) ..... 104210444 U

(51) Int. Cl.
*A61H 3/04* (2006.01)
*A61H 3/00* (2006.01)

(52) U.S. Cl.
CPC ..... *A61H 3/04* (2013.01); *A61H 3/00* (2013.01); *A61H 2201/0161* (2013.01)

(58) Field of Classification Search
CPC ..... A61H 3/04; A61H 2201/0161
USPC ..... 135/74; 403/322.4
See application file for complete search history.

(56) References Cited

U.S. PATENT DOCUMENTS 3,688,789 A * 9/1972 Bunch ..... A61H 3/00 135/67
5,201,333 A * 4/1993 Shalmon ..... A61H 3/00 135/67
5,275,187 A * 1/1994 Davis ..... A61H 3/00 135/67
5,529,425 A * 6/1996 Spies ..... A61H 3/00 135/74
5,692,762 A * 12/1997 Obitts ..... A61H 3/04 280/87.05
5,862,825 A * 1/1999 Leonard ..... A61H 3/00 135/67
6,729,342 B2 * 5/2004 Serhan ..... A61H 3/00 135/67
6,886,575 B2 * 5/2005 Diamond ..... A45B 7/00 135/67
7,278,436 B2 * 10/2007 Gale ..... A45B 7/00 135/67

(Continued)

*Primary Examiner* — David R Dunn
*Assistant Examiner* — Danielle Jackson
(74) *Attorney, Agent, or Firm* — Burris Law, PLLC

(57) ABSTRACT

A foldable walker includes a front frame having left and right pin holes, two side frame units pivotably connected to the front frame, and two locking units. Each locking unit is disposed between the front frame and the respective side frame unit, and includes a lock releasing lever and a locking pin. The lock releasing lever has a pulling fulcrum portion, an operating portion opposite to the pulling fulcrum portion, and a pressing fulcrum portion disposed therebetween. An upwardly pulling action or a downwardly pressing action onto the operating portion permits rotation of the respective side frame unit between folded and unfolded positions. The locking pin is disposed between the pulling and pressing fulcrum portions to be inserted into the respective pin hole to lock the side frame units to the unfolded position, and is moved by the upwardly pulling action or the downwardly pressing action.

12 Claims, 9 Drawing Sheets

(56) References Cited

U.S. PATENT DOCUMENTS

| | | | | |
|---|---|---|---|---|
| 7,497,226 | B2 * | 3/2009 | Li | A61H 3/00 135/67 |
| 7,506,657 | B2 * | 3/2009 | Hsiao | A61H 3/00 135/67 |
| 7,651,649 | B2 * | 1/2010 | Obitts | A61H 3/00 264/242 |
| 7,703,465 | B2 * | 4/2010 | Diamond | A45B 7/00 135/67 |
| 2006/0278260 | A1 * | 12/2006 | Su | A45B 7/00 135/67 |
| 2007/0023073 | A1 * | 2/2007 | Su | A61H 3/04 135/67 |
| 2007/0199586 | A1 * | 8/2007 | Cheng | A61H 3/04 135/67 |

* cited by examiner

FOLDABLE WALKER

CROSS-REFERENCE TO RELATED APPLICATION

This application claims priority of Taiwanese Patent Application No. 104210444, filed on Jun. 29, 2015.

FIELD

The disclosure relates to an ambulatory device, and more particularly to a foldable walker.

BACKGROUND

A conventional walker as shown in FIGS. 1 and 2 includes a front frame 4 having two pin holes 41, two side frame units 5 and two locking units 6. Each of the side frame units 5 includes a side frame body 51 and an adaptor 52 sleeved on the side frame body 51. Each of the locking units 6 includes a lock releasing lever 61 mounted on the adaptor 52, a locking pin 62 extending through the adaptor 52, connected to the lock releasing lever 61 and movably inserted into the respective pin hole 41 to lock the side frame body 51 relative to the front frame 4, and a spring 63 connected to the adaptor 52 and the locking pin 62. An upwardly pulling action to the lock releasing lever 61 results in upward movement and removal of the locking pin 62 from the respective pin hole 41 so as to permit turning of the side frame body 51 relative to the front frame 4 in folded and unfolded positions.

Such a walker is generally used to assist ambulation and provide additional stability for people who are elderly, infirm, have a disability, or are in rehabilitation, and who cannot sufficiently apply an upward pulling action to the lever 61 for releasing the locking pin.

SUMMARY

Therefore, an object of the disclosure is to provide a foldable walker that has locking units which can be operated in two locking directions.

According to the disclosure, the foldable walker includes a front frame, two side frame units and two locking units. The front frame has left and right pin holes disposed opposite to each other in a transverse direction and each extending therethrough in an upright direction. Each of the side frame units has a front portion which is pivotably connected to a respective one of left and right ends of the front frame, and a rear portion which is opposite to the front portion so as to be turnable relative to the front frame between a folded position, where the rear portion is close to the front frame, and an unfolded position, where the rear portion is remote from the front frame to be disposed opposite to the front portion in a longitudinal direction that is perpendicular to the transverse direction. Each of the locking units is disposed between the front frame and a respective one of the side frame units, and includes a lock releasing lever and a locking pin. The lock releasing lever is mounted on the respective one of the side frame units and has a pulling fulcrum portion, an operating portion opposite to the pull fulcrum portion, and a pressing fulcrum portion disposed between the pulling fulcrum portion and the operating portion. The pulling fulcrum portion is configured so as to permit rotation of the lock releasing lever about the pulling fulcrum portion in response to an upwardly pulling action onto the operating port ion. The pressing fulcrum portion is configured so as to permit rotation of the lock releasing lever about the pressing fulcrum portion in response to a downwardly pressing action onto the operating portion. The locking pin extends in the upright direction and has an end which extends through the lock releasing lever and between the pulling and pressing fulcrum portions, and an opposite end which extends through the respective one of the side frame units and which is disposed to be inserted into a respective one of the left and right pin holes so as to lock the respective one of the side frame units to the unfolded position. The upwardly pulling action or the downwardly pressing action onto the operating portion permits removal of the lock pin from the respective one of the left and right pin holes so as to permit turning of the respective one of the side frame units to the folded position.

BRIEF DESCRIPTION OF THE DRAWINGS

Other features and advantages of the disclosure will become apparent in the following detailed description of the embodiment with reference to the accompanying drawings, of which.

DETAILED DESCRIPTION

Figure 1:
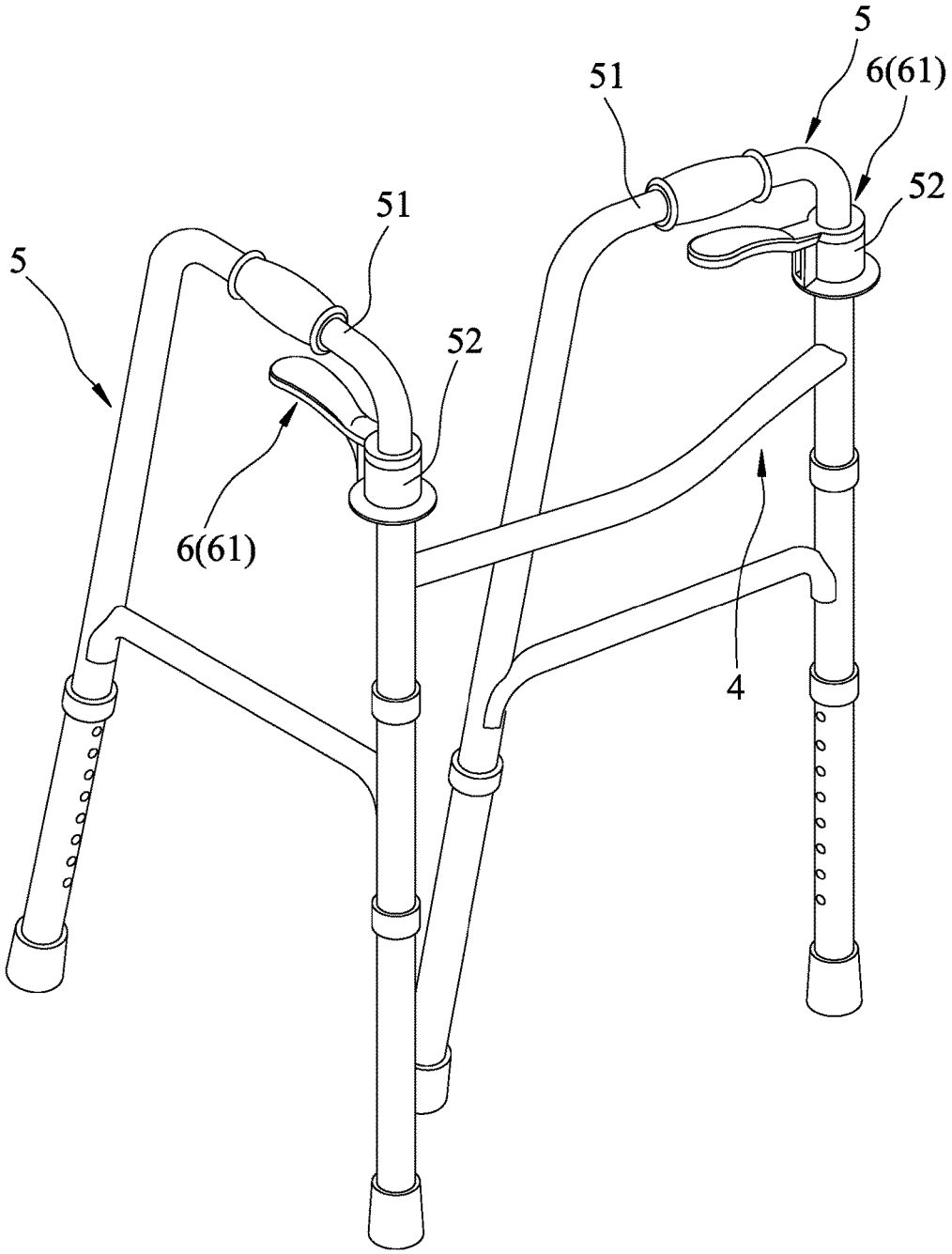
FIG.1 PRIOR ART
FIG. 1 is a perspective view of a conventional foldable walker.
Figure 2:
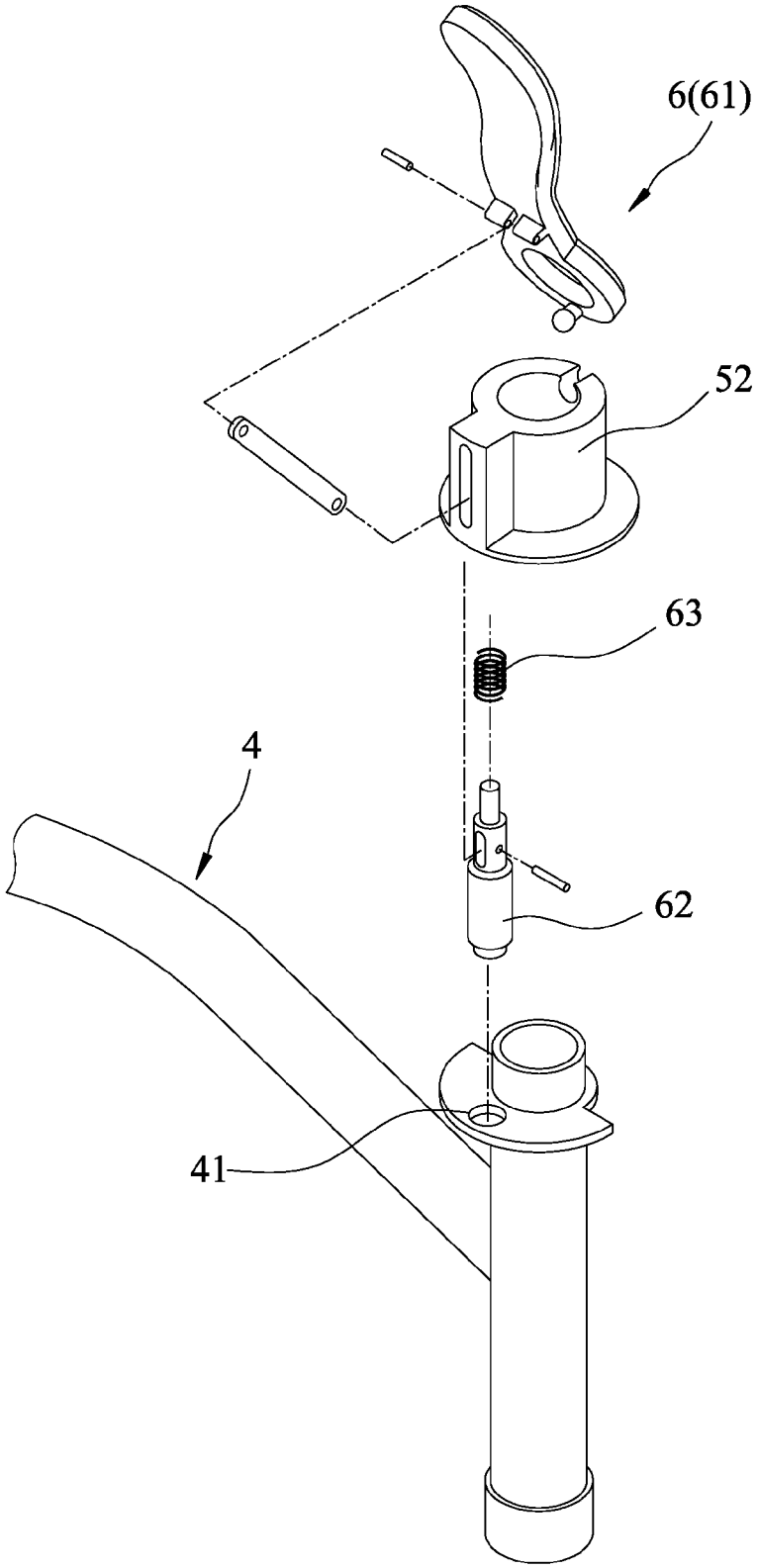
FIG.2 PRIOR ART
FIG. 2 is an exploded perspective view illustrating a locking unit of the conventional foldable walker.

Before the disclosure is described in greater detail, it should be noted that where considered appropriate, reference numerals or terminal portions of reference numerals have been repeated among the figures to indicate corresponding or analogous elements, which may optionally have similar characteristics.

Figure 3:
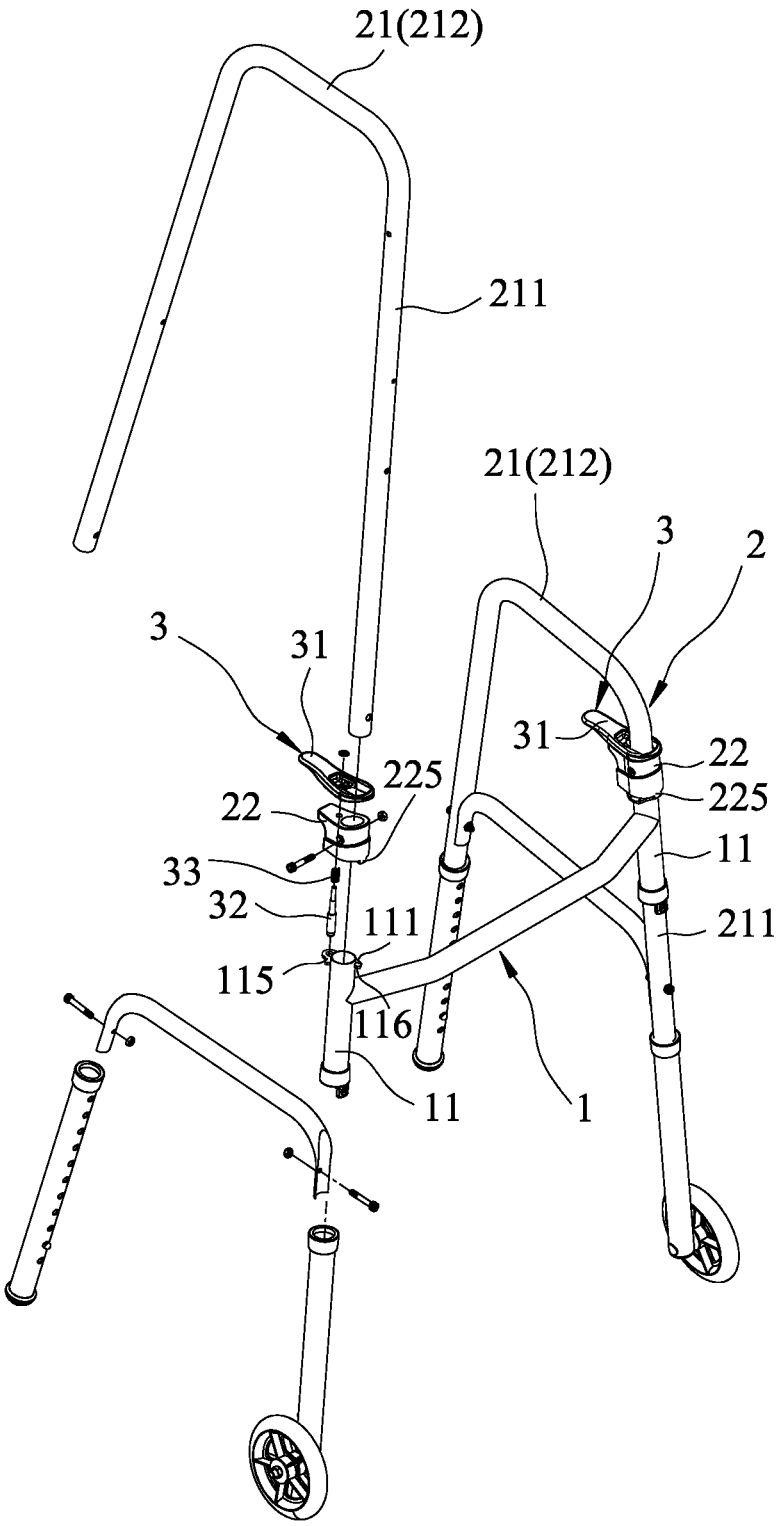
FIG. 3 is an exploded perspective view illustrating an embodiment of foldable walker according to the disclosure.
Figure 4:
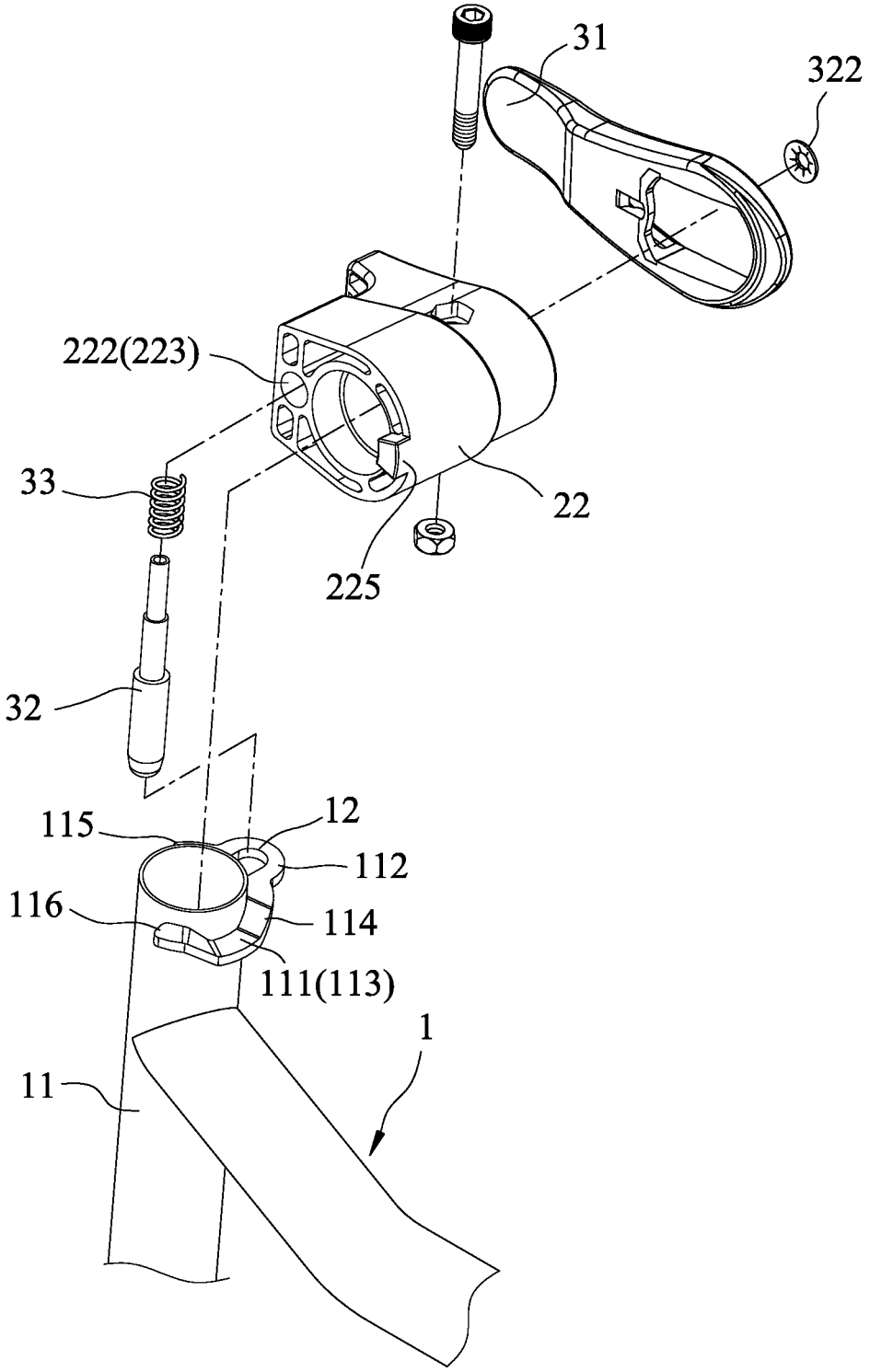
FIG. 4 is an exploded perspective view illustrating a locking unit of the embodiment.
Figure 5:
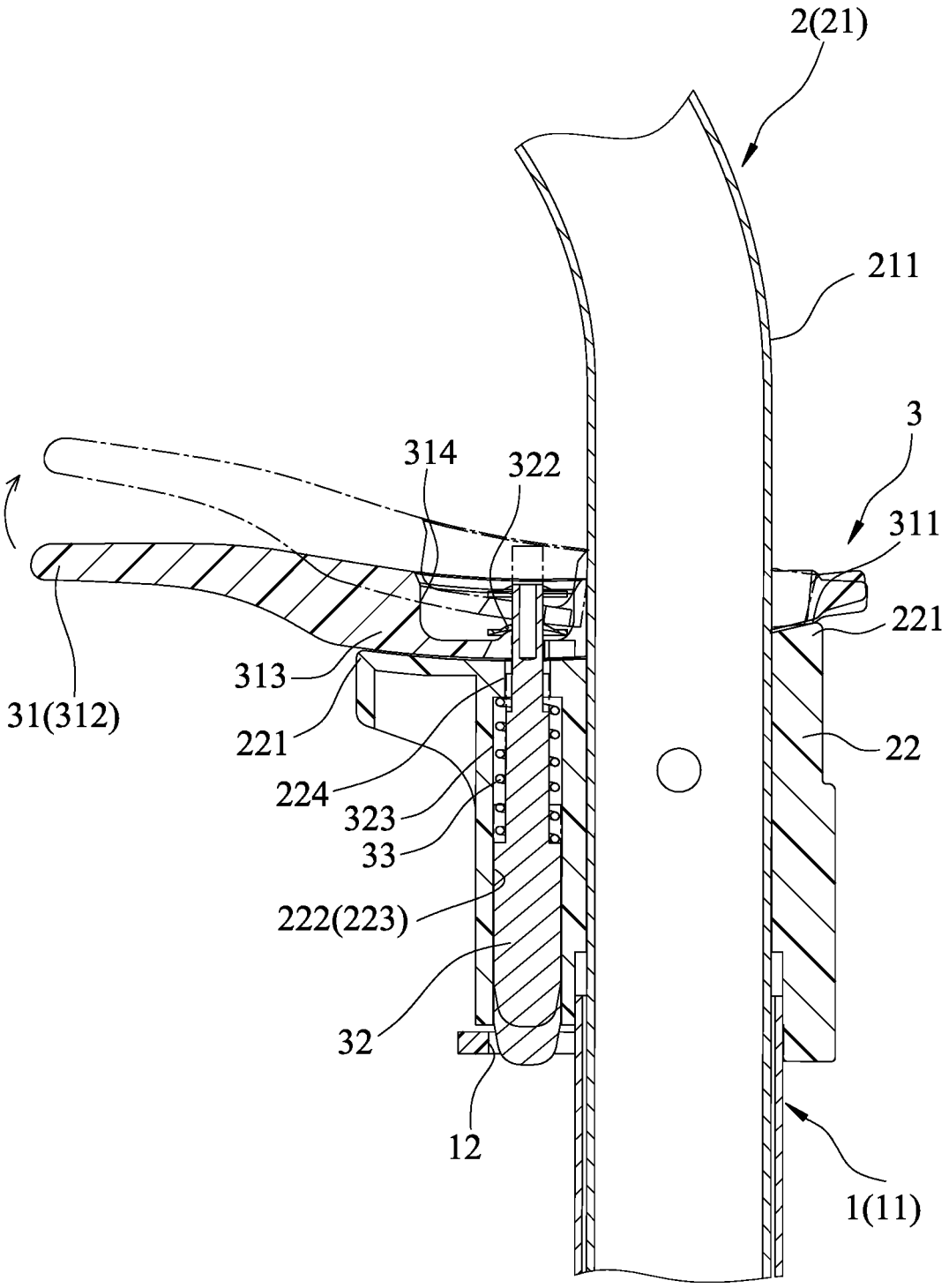
FIG. 5 is a sectional view illustrating a state where an upwardly pulling action is applied to the locking unit of the embodiment.

Referring to FIGS. 3 to 5, the embodiment of the foldable walker according to the invention is shown to include a front frame 1, two side frame units 2 and two locking units 3.

The front frame 1 includes left and right upright tubes 11 disposed opposite to each other in a transverse direction, and left and right pin holes 12. Each of the left and right upright tubes 11 has an upper end which extends radially and outwardly to form an annular seat portion 111. The annular seat portion 111 has a pin hole segment 112 formed with a respective one of the left and right pin holes 12, a pin positioning segment 113 disposed lower than the pin hole segment 112, and a shoulder segment 114 interposed between the pin hole segment 112 and the pin positioning segment 113. Each of the pin holes 12 penetrates the pin hole segment 112 in an upright direction. The annular seat portion 111 defines an annular guiding slot 115 and has a stop wall 116 facing the annular guiding slot 115 and remote from the pin hole segment 112. In this embodiment, the pin positioning segment 113 extends annularly to terminate at the stop wall 116. The front frame 1 is in the form of an H-shaped frame.

Each of the side frame units 2 has a front portion which is pivotably connected to a respective one of the left and right upright tubes 11 of the front frame 1, and a rear portion which is opposite to the front portion so as to be turnable relative to the front frame 1 between a folded position, where the rear portion is close to the front frame 1, and an unfolded position, where the rear portion is remote from the front frame 1 to be disposed opposite to the front portion in a longitudinal direction that is perpendicular to the transverse direction. In particular, each of the side frame units 2 includes a frame body 21 and an adaptor 22. The frame body 21 has a pivot tube 211 serving as the front portion which is pivotably connected to the upright tube 11, and a handgrip tube 212 extending rearwardly from the pivot tube 211. The adaptor 22 is sleeved on the pivot tube 211 and has front and rear bearing portions 221 (as will be further described below), a pin sliding portion 222 disposed between the bearing portions 221 and defined by an inner peripheral wall 223 which extends upwardly to terminate at an abutting wall 224, and a positioning post 225 disposed opposite to the pin sliding portion 222 and extending downwardly into the annular guiding slot 115.

Each of the locking units 3 is disposed between the front frame 1 and the respective side frame unit 2, and includes a lock releasing lever 31, a locking pin 32 and a spring 33.

Figure 6:
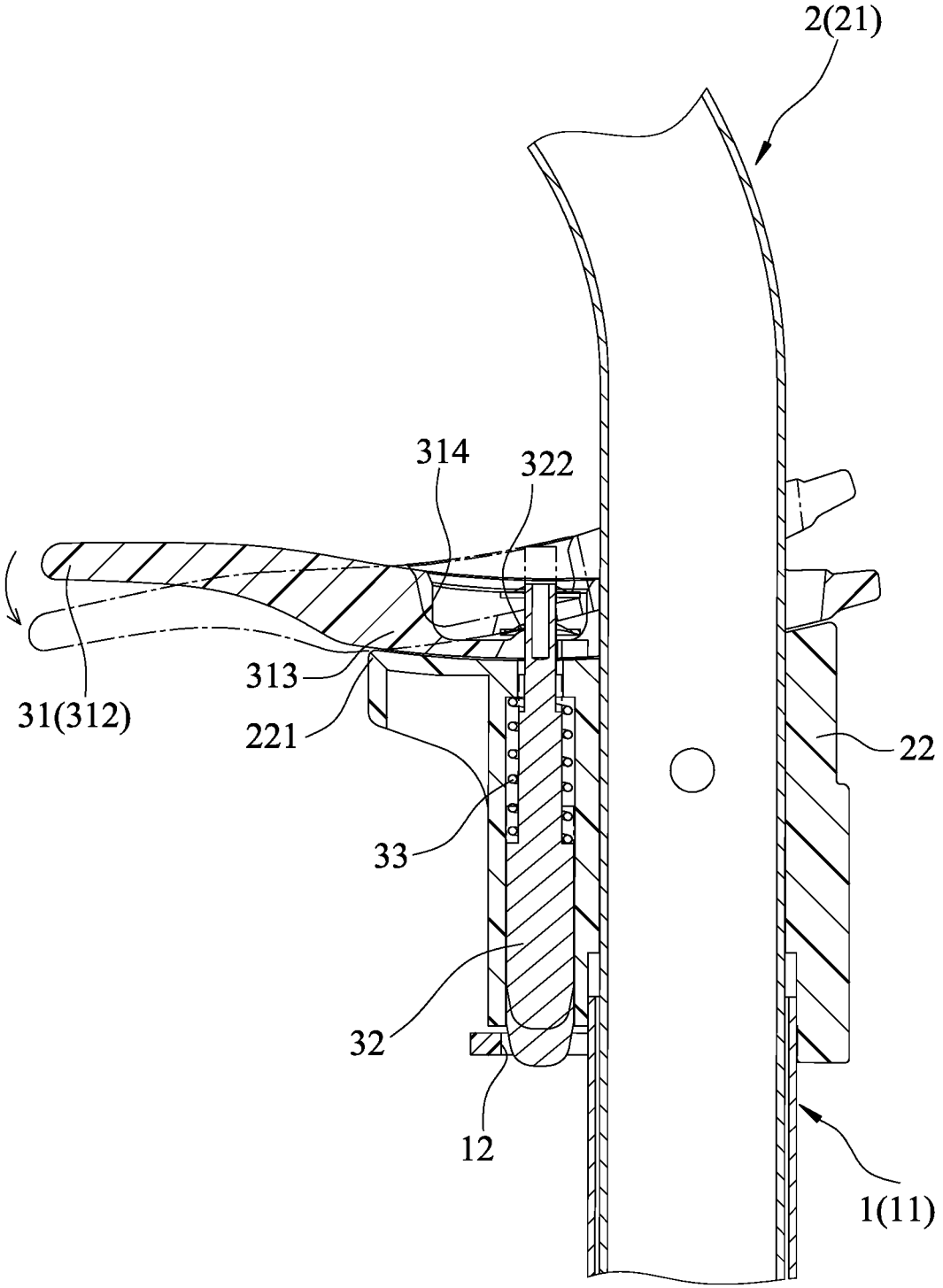
FIG. 6 is a sectional view illustrating a state where a downwardly pressing action is applied to the locking unit of the embodiment.

The lock releasing lever 31 is mounted on the adaptor 22 such that the pivot tube 211 extends through the lock releasing lever 31 and the adaptor 22. The lock releasing lever 31 has a pulling fulcrum portion 311, an operating portion 312 opposite to the pull fulcrum portion 311, a pressing fulcrum portion 313 disposed between the pulling fulcrum portion 311 and the operating portion 312, and a recess 314 formed in an upper wall thereof. The positioning post 225 of the adaptor 22 is disposed at a position adjacent to the pulling fulcrum portion 311. The pulling fulcrum portion 311 is configured so as to permit rotation of the lock releasing lever 31 about the pulling fulcrum portion 311 born by the front bearing portion 221 in response to an upwardly pulling action onto the operating portion 312, as shown in FIG. 5. The pressing fulcrum portion 313 is configured so as to permit rotation of the lock releasing lever 31 about the pressing fulcrum portion 313 borne by the rear bearing portion 221 in response to a downwardly pressing action onto the operating portion 312, as shown in FIG. 6. Moreover, the operating portion 312 of the lock releasing lever 31 is disposed below and adjacent to the handgrip tube 212 and extends in a direction substantially parallel to that of the handgrip tube 212 in the unfolded position.

The locking pin 32 extends in the upright direction and has an end which extends through the lock releasing lever 31 and between the pulling and pressing fulcrum portions 311, 313, and an opposite end which is slidably received in the pin sliding portion 222 to be inserted into the respective pin hole 12 so as to lock the respective frame body 21 to the unfolded position. The locking pin 32 is configured to define with the inner peripheral wall 223 and the abutting wall 224 a receiving space 323 for receiving the spring 33. The spring 33 is connected to the abutting wall 224 and the locking pin 32 so as to bias the locking pin 32 downwardly. The locking pin 32 further has a connecting member 322 disposed to interconnect the end of the locking pin 32 and the lock releasing lever 31 so as to permit movement of the locking pin 32 in response to the upwardly pulling and downwardly pressing actions of the lock releasing lever 31. The connecting member 322 is received in and concealed by the recess 314.

Figure 7:
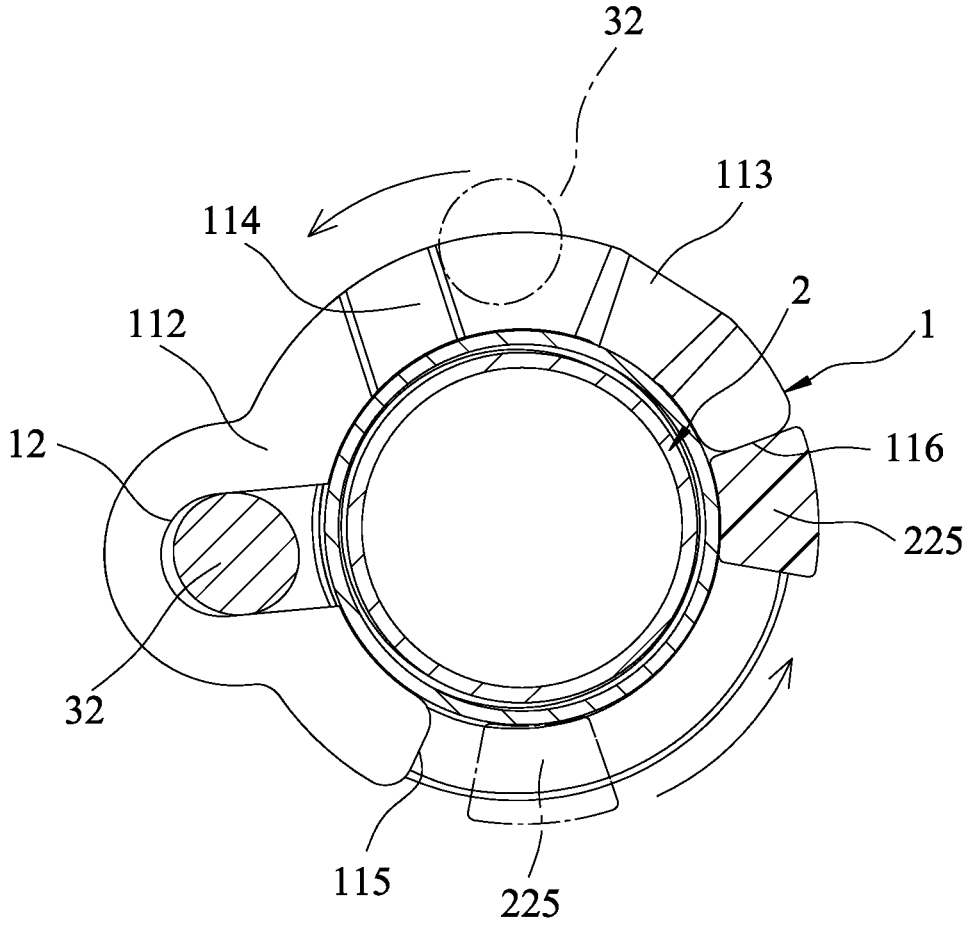
FIG. 7 is a cross-sectional view illustrating a state of a locking pin and a positioning post of the locking unit of the embodiment.
Figure 8:
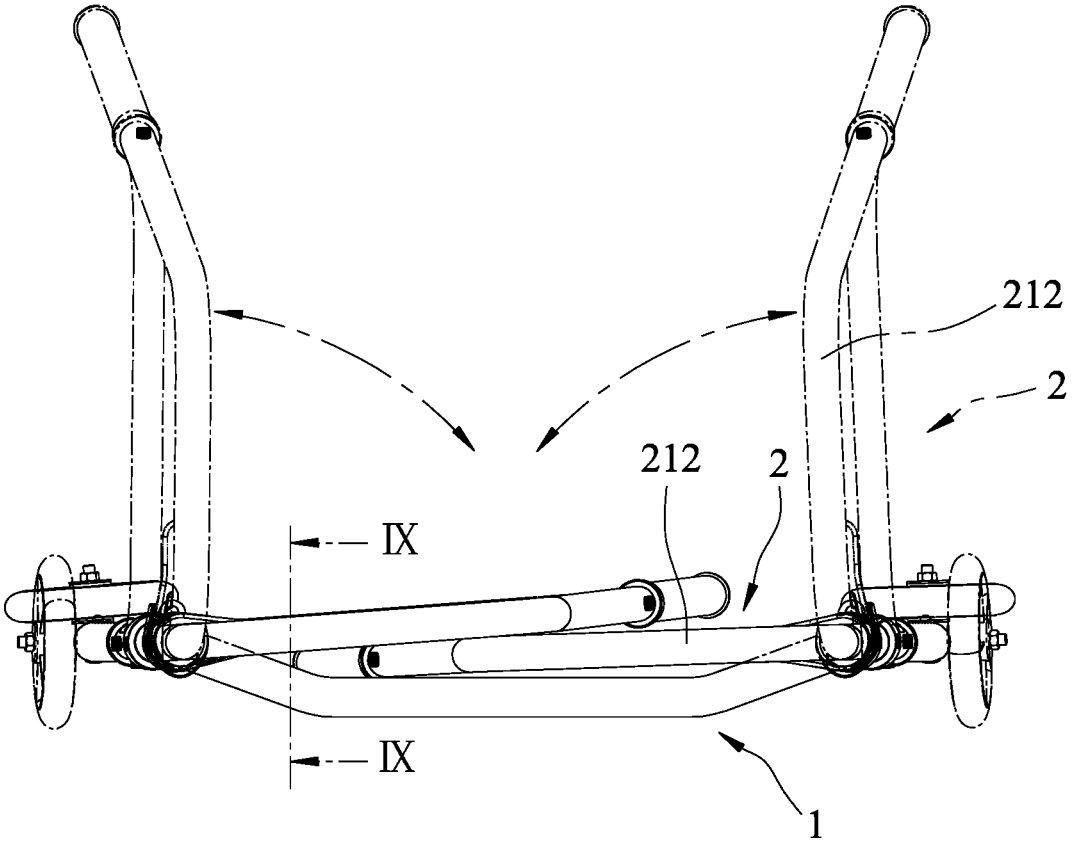
FIG. 8 is a top view illustrating the embodiment in folded and unfolded states.

With reference to FIGS. 6 to 8, when it is desired to unfold the side frame units 2, an upwardly pulling action or a downwardly pressing action is applied onto the operating portion 312 of the lock releasing lever 31 to move the locking pin 32 upwardly to be higher than the respective pin hole 12. The respective side frame unit 2 is then turned to the unfolded position such that the positioning post 225 is moved along the annular guiding slot 115 until the positioning post 225 abuts against the stop wall 116. At this time, the locking pin 32 is registered with the respective pin hole 12 in the upright direction such that the locking pin 32 is biased to be inserted into the respective pin hole 12 by means of the spring 33 so as to lock the side frame unit 2 in the unfolded position.

When it is desired to fold the side frame units 2, an upwardly pulling action or a downwardly pressing action is applied onto the operating portion 312 of the lock releasing lever 31 to remove the locking pin 32 from the respective pin hole 12, and the side frame units 2 are turned to the folded position such that the positioning post 225 is moved to be remote from the stop wall 116 and that the locking pin 32 is moved to be disposed on the pin positioning segment 113 and to be hindered by the shoulder segment 114.

With reference to FIGS. 3, 5 and 8, a user grips the handgrip tubes 212 of the side frame units 2 and can easily operate the operating portions 312, since the operating portions 312 is disposed adjacent to the handgrip tubes 212, so as to apply an upwardly pulling action to the respective operating portion 312 for folding and unfolding the respective side frame unit 2.

With reference to FIGS. 3, 6 and 8, alternatively, a user grips and presses the operating portions 312 downwardly to abut the pressing fulcrum portions 313 against the rear bearing portions 221 so as to permit turning of the lock releasing levers 31 about the pressing fulcrum portions 313. At this time, the locking pins 32 which are disposed opposite to the operating portions 312 in terms of the pressing fulcrum portions 313 are pulled upwardly in the manner of a lever to be removed from the pin holes 12 so as to permit turning of the side frame units 2 relative to the front frame 1.

Figure 9:
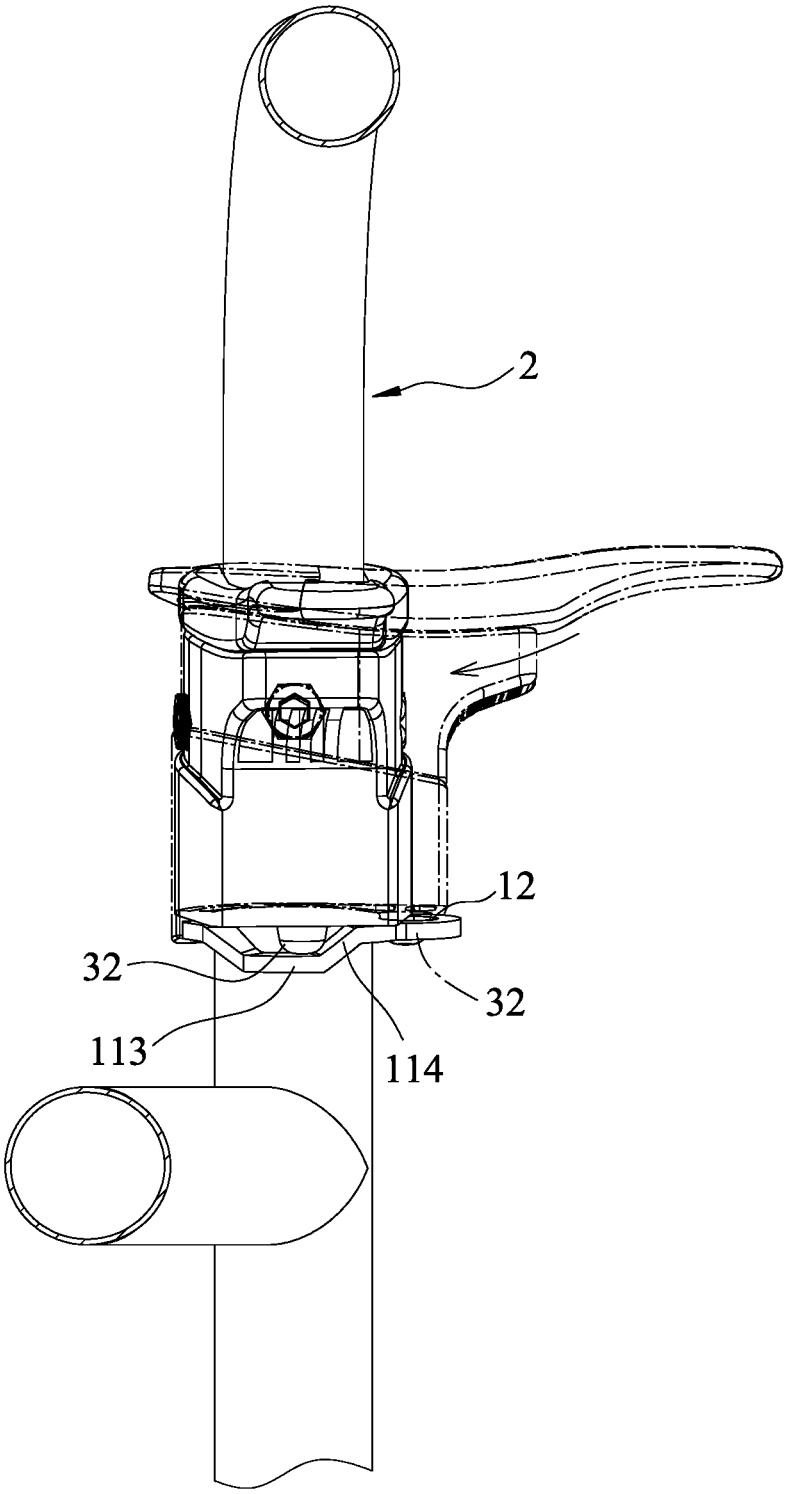
FIG. 9 is a sectional view taken along IX-IX of FIG. 8.

With reference to FIGS. 7 and 9, in the folded position, by means of the biasing action of the springs 33 (see FIG. 4), the locking pins 32 are positioned firmly on the pin positioning segments 113 so as to prevent undesired turning of the side frame units 2. Additionally, the locking pins 32 are hindered by the shoulder segments 114 from movement toward the unfolded position.

As illustrated, the foldable walker of this embodiment according to the invention can be operated in two operating directions for comfortable use.

While the disclosure has been described in connection with what is considered the exemplary embodiment, it is understood that this disclosure is not limited to the disclosed embodiment but is intended to cover various arrangements included within the spirit and scope of the broadest interpretation so as to encompass all such modifications and equivalent arrangements.

What is claimed is:

1. A foldable walker comprising:

a front frame having left and right pin holes disposed opposite to each other in a transverse direction and each extending therethrough in an upright direction;

two side frame units, each having a front portion which is pivotably connected to a respective one of left and right ends of said front frame, and a rear portion which is opposite to said front portion so as to be turnable relative to said front frame between a folded position, where said rear portion is close to said front frame, and an unfolded position, where said rear portion is remote from said front frame to be disposed opposite to said front portion in a longitudinal direction that is perpendicular to the transverse direction; and two locking units, each disposed between said front frame and a respective one of said side frame units, and each including a lock releasing lever and a locking pin, said lock releasing lever being mounted on the respective one of said side frame units and having a pulling fulcrum portion, an operating portion opposite to said pull fulcrum portion, and a pressing fulcrum portion disposed between said pulling fulcrum portion and said operating portion, said pulling fulcrum portion being configured so as to permit rotation of said lock releasing lever about said pulling fulcrum portion in response to an upwardly pulling action onto said operating portion, said pressing fulcrum portion being configured so as to permit rotation of said lock releasing lever about said pressing fulcrum portion in response to a downwardly pressing action onto said operating portion, said locking pin extending in the upright direction and having an end which extends through said lock releasing lever and between said pulling and pressing fulcrum portions, and an opposite end which extends through the respective one of said side frame units and which is disposed to be inserted into a respective one of said left and right pin holes so as to lock the respective one of said side frame units to the unfolded position, the upwardly pulling action or the downwardly pressing action onto said operating portion permitting removal of said lock pin from the respective one of said left and right pin holes so as to permit turning of the respective one of said side frame units to the folded position.

2. The foldable walker of claim 1, wherein each of said side frame units includes a frame body and an adaptor, said frame body having a pivot tube serving as said front portion which extends through said lock releasing lever and said adaptor, said adaptor being sleeved on said pivot tube and disposed to bear said pulling fulcrum portion and said pressing fulcrum portion of said lock releasing lever with two bearing portions, said adaptor further having a pin sliding portion disposed between said bearing portions for slidably receiving said opposite end of said locking pin.

3. The foldable walker of claim 2, wherein said each of said locking units further includes a spring connected to said adaptor and said locking pin so as to bias said locking pin downwardly.

4. The foldable walker of claim 3, wherein said adaptor has an inner peripheral wall defining said pin sliding portion and extending toward said lock releasing lever to terminate at an abutting wall, said locking pin being configured to define with said inner peripheral wall and said abutting wall a receiving space for receiving said spring.

5. The foldable walker of claim 4, wherein said locking pin further has a connecting member disposed to interconnect said end of said locking pin and said lock releasing lever so as to permit movement of said locking pin in response to the upwardly pulling and downwardly pressing actions of said lock releasing lever.

6. The foldable walker of claim 5, wherein said lock releasing lever has a recess formed in an upper wall thereof so as to receive and conceal said connecting member.

7. The foldable walker of claim 4, wherein said front frame includes left and right upright tubes, each pivotably connected to said pivot tube, and each having an upper end which extends radially and outwardly to form an annular seat portion, a respective one of said left and right pinholes being formed in said annular seat portion.

8. The foldable walker of claim 7, wherein said annular seat portion defines an annular guiding slot and having a stop wall facing said annular guiding slot, said adaptor further having a positioning post disposed opposite to said pin sliding portion and extending downwardly into said annular guiding slot such that said positioning post abuts against said stop wall when said locking pin is registered with the respective one of said left and right pin holes in the upright direction.

9. The foldable walker of claim 8, wherein said annular seat portion has a pin hole segment formed with the respective one of said left and right pin holes, a pin positioning segment disposed lower than said pin hole segment, and a shoulder segment interposed between said pin hole segment and said pin positioning segment such that, when a respective one of said side frame units is in the folded position, said locking pin is disposed on said pin positioning segment and hindered by said shoulder segment, and such that, when the respective one of said side frame units is in the unfolded position, said locking pin is inserted into the respective one of said left and right pin holes.

10. The foldable walker of claim 9, wherein said pin positioning segment extends annularly to terminate at said stop wall, said positioning post being disposed at a position adjacent to said pulling fulcrum portion such that, in the folded position, said positioning post is remote from said stop wall, and such that, in the unfolded position, said positioning post is abutted against said stop wall.

11. The foldable walker of claim 2, wherein each of said side frame units further has a handgrip tube extending rearwardly from said pivot tube.

12. The foldable walker of claim 11, wherein said operating portion of said lock releasing lever is disposed below and adjacent to said handgrip tube and extends in a direction substantially parallel to that of said handgrip tube in the unfolded position.

* * * * *